US007165955B2

(12) United States Patent
Enzaka et al.

(10) Patent No.: US 7,165,955 B2
(45) Date of Patent: Jan. 23, 2007

(54) TROCHOID TYPE OIL PUMP

(75) Inventors: Kazuo Enzaka, Gunma-ken (JP); Yasunori Ono, Gunma-ken (JP); Masahiro Kasahara, Gunma-ken (JP); Yoshiaki Senga, Gunma-ken (JP); Ken Kaneko, Gunma-ken (JP); Takahiro Sato, Gunma-ken (JP)

(73) Assignees: Honda Motor Co., Ltd., Tokyo (JP); Yamada Manufacturing Co., Ltd., Gunma-ken (JP)

( * ) Notice: Subject to any disclaimer, the term of this patent is extended or adjusted under 35 U.S.C. 154(b) by 208 days.

(21) Appl. No.: 10/896,021

(22) Filed: Jul. 22, 2004

(65) Prior Publication Data

US 2005/0019196 A1 Jan. 27, 2005

(30) Foreign Application Priority Data

Jul. 25, 2003 (JP) ..... P2003-280512

(51) Int. Cl.
*F01C 1/10* (2006.01)

(52) U.S. Cl. ..... 418/171; 418/180; 418/189

(58) Field of Classification Search ..... 418/61.3, 418/170, 171, 166, 180, 189
See application file for complete search history.

(56) References Cited

U.S. PATENT DOCUMENTS 3,072,067 A * 1/1963 Beller ..... 418/82
3,635,604 A * 1/1972 Petersen et al. ..... 417/304
4,767,296 A * 8/1988 Satomoto et al. ..... 418/171
5,096,398 A * 3/1992 Cozens ..... 418/171
5,413,470 A * 5/1995 Eisenmann ..... 418/171
5,518,380 A * 5/1996 Fujii et al. ..... 418/26
6,544,021 B2 * 4/2003 Watanabe et al. ..... 418/171

FOREIGN PATENT DOCUMENTS

JP 5-50595 7/1993

* cited by examiner

*Primary Examiner*—Hoang Nguyen
(74) *Attorney, Agent, or Firm*—McGinn IP Law Group, PLLC

(57) ABSTRACT

It is an object of the present invention to provide a trochoid type oil pump in which erosion of the rotor surfaces caused by cavitation is minimized, vibration and noise are reduced, and the structure is greatly simplified. The trochoid type oil pump of the present invention comprises a rotor chamber which has an intake port and a discharge port, an outer rotor, an inner rotor, and shallow grooves which are formed on the side of the initial end portion of the discharge port on the circular circumference of the track of the positions of the bottom portions of the teeth created by the rotation of the outer rotor. In a state in which the sealed spaces formed by the outer rotor, the inner rotor and a partition part between the final end portion of the intake port and the initial end portion of the discharge port are reduced in volume from the maximum volume, the sealed spaces Sa are caused to communicate with the shallow grooves.

20 Claims, 18 Drawing Sheets

TROCHOID TYPE OIL PUMP

BACKGROUND OF THE INVENTION

1. Field of the Invention

The present invention relates to a trochoid type oil pump which minimizes erosion of the rotor surfaces caused by cavitation, which reduces vibration and noise, and which has an extremely simple structure.

2. Description of the Related Art

A trochoid type oil pump which is installed in a housing so that thin grooves that immediately communicate with sealed spaces (formed by an outer rotor and an inner rotor) that shift from a maximum volume state of these sealed spaces to a volume reduction stroke extend in the form of circular arcs in the counter-rotational direction from the initial end portion of the discharge chamber to at least the position where the tips of the teeth of the outer rotor and inner rotor first make contact along the direction of rotation at the time of maximum volume is described in Japanese Patent Publication No. 5-50595.

SUMMARY OF THE INVENTION

The circular arc form thin grooves simply communicate with the sealed spaces 15. Furthermore, the thin grooves shown in FIG. 4 in Japanese Patent Publication No. 5-50595 are indicated as grooves that have a fine groove shape, and that allow easy groove working. Furthermore, the thin grooves shown in FIG. 5 in Japanese Patent Publication No. 5-50595 are indicated as grooves with a shape in which the groove width gradually increases in accordance with the rotation of the outer rotor and inner rotor. The tip end portions of these thin grooves, i.e., the locations where the grooves join with the sealed spaces 15 formed by the outer rotor and inner rotor, are indicated in the figures as being positioned on the side of the installation region of the outer rotor.

Furthermore, these thin grooves have a structure which is such that the sealed spaces 15 and discharge chamber gradually communicate, without a state of communication being immediately initiated. As a result of such a structure, oil is caused to flow out from the sealed spaces 15 into the discharge chamber in a gradual manner, and the back flow of oil into the sealed spaces 15 from the discharge chamber is checked, so that the occurrence of pressure fluctuations in the sealed spaces 15 can be prevented. Specifically, it is an object in this case to prevent the back flow of oil into the sealed spaces 15 from the discharge chamber, and this problem is solved by the formation of circular arc form thin grooves as means of achieving the object with respect to this problem.

Furthermore, these thin grooves prevent the abrupt communication of the sealed spaces 15 with the discharge chamber, and thus prevent the back flow of oil into the sealed spaces 15 from the discharge chamber; moreover, these thin grooves also make the flow of oil between the sealed spaces 15 and the discharge chamber more gradual. Such thin grooves easily destroy the small mass of air and cavitation bubbles contained in the oil in the intake stroke of the sealed spaces 15. Accordingly, the cavitation destructive force is strong, so that abrupt pressure variations occur in the volume, thus making it difficult to reduce noise and the erosion of the teeth of the rotors. A problem that is to be solved by the present invention (i.e., a technical task, object or the like) is to reduce the effect of the cavitation destructive force of the sealed spaces that communicate with the thin grooves disposed on the side of the discharge chamber.

Accordingly, the present inventor conducted diligent research in order to solve the problem. As a result, the problem is solved by constituting the present invention as a trochoid type oil pump comprising a rotor chamber which has an intake port and a discharge port, outer and inner rotors, and shallow grooves which are formed on the side of the initial end portion of the discharge port on the circular circumference of the track of the positions of the bottom portions of the teeth created by the rotation of the outer rotor, wherein, in a state in which the sealed spaces formed by the outer rotor, the inner rotor and a partition part between the final end portion of the intake port and the initial end portion of the discharge port gradually decrease from a maximum value, the sealed spaces are gradually caused to communicate with the shallow grooves, or a trochoid type oil pump which is devised so that when the volume is reduced by 1% to 6% in the maximum state of the sealed spaces, the sealed spaces are caused to communicate with the shallow grooves.

Furthermore, the problem is similarly solved by constituting a trochoid type oil pump in which the shallow grooves are formed in a circular arc shape that runs along the longitudinal direction, and are formed either uniformly or non-uniformly on the circular circumference of the track of the positions of the bottom portions of the teeth of the outer rotor, or by constituting a trochoid type oil pump in which the shallow grooves are formed in a rectilinear shape that runs along the longitudinal direction, and are disposed either uniformly or non-uniformly on the circular circumference of the track of the positions of the bottom portions of the teeth of the outer rotor.

Furthermore, the problem is also solved by constituting a trochoid type oil pump comprising a rotor chamber which has an intake port and a discharge port, outer and inner rotors, and shallow grooves which are formed on the side of the initial end portion of the discharge port on the circular circumference of the track of the positions of the bottom portions of the teeth created by the rotation of the outer rotor, wherein, in a state of maximum volume formed by the outer rotor, the inner rotor and the partition part between the final end portion of the intake port and the initial end portion of the discharge port, this space communicates with the shallow grooves or the intake port and the shallow grooves.

In the invention of claim 1, the destructive force of cavitation bubbles can be reduced, so that vibration and noise can be reduced; furthermore, the structure can be simplified. Next, in claim 2, vibration and noise can be prevented to an even greater extent. Next, in claims 3 and 4, the state of communication between the sealed spaces and the discharge port is further improved. In claim 5, vibration and noise can be reduced, and the structure can be simplified.

DESCRIPTION OF THE PREFERRED EMBODIMENTS

Figure 1A:
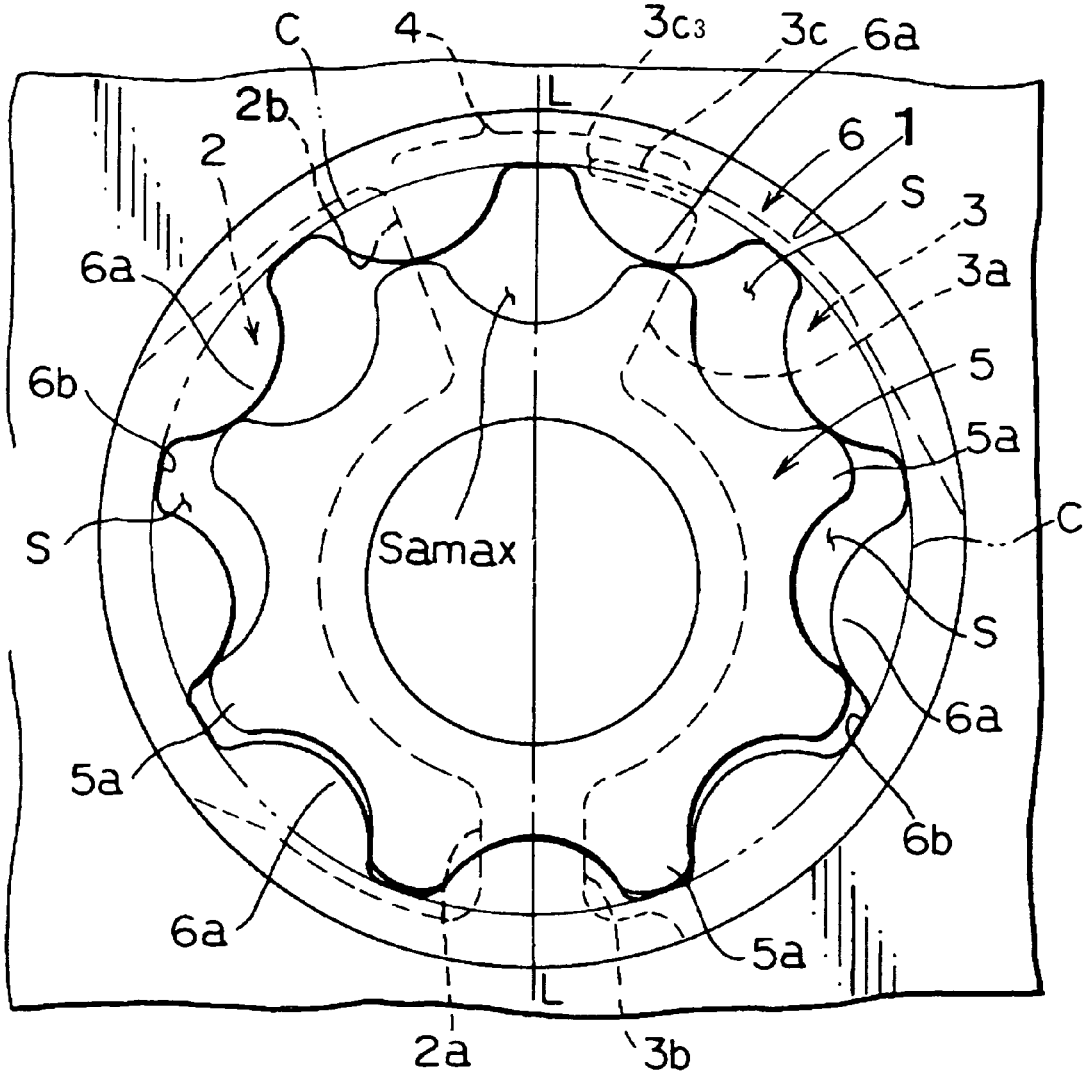
FIG. 1A is a front view showing a preferred embodiment of the present invention.

Preferred embodiments of the present invention will be described below with reference to the attached figures. As is shown in FIG. 1A, the trochoid pump of the present invention is a pump in which an inner rotor 5 and outer rotor 6 that have a trochoidal tooth shape are contained in a rotor chamber 1 formed inside a pump casing. An intake port 2 and a discharge port 3 are formed in the rotor chamber 1, in positions located substantially on the outer circumferential side along the circumferential direction. The intake port 2 and discharge port 3 are formed in positions that show left-right symmetry with respect to the center of the rotor chamber 1. In concrete terms, in a case where a vertical line passing through the center of the rotor chamber 1 with respect to the lateral direction is taken as an imaginary line L of left-right symmetry, the intake port 2 is formed and disposed on the left side of this line L of left-right symmetry, and the discharge port 3 is formed and disposed on the right side of the same line, so that the intake port 2 and discharge port 3 are disposed on the left and right.

The inner rotor 5 has one fewer teeth than the outer rotor 6, so that when the inner rotor 5 rotates, the outer rotor 6 rotates while lagging behind by an amount corresponding to one tooth. Thus, the inner rotor 5 has tooth shapes 5*a* that protrude outward, and tooth bottom portions 5*b* that are indented inward; similarly, the outer rotor 6 has tooth shapes 6*a* that protrude toward the center from the side of the inner circumference, and indented tooth bottom portions 6*b*.

In the intake port 2, the inter-tooth spaces S that are formed by the alternating tooth shapes 5*a* and tooth shapes 6*a* are caused to move by the rotation of the inner rotor 5 and outer rotor 6, so that the end portion that initially reaches the intake port 2 constitutes the initial end portion 2*a* of the intake port 2, and so that the end portion that is removed from the intake port 2 as a result of the rotation of the inter-tooth spaces S constitutes the final end portion 2*b*. Similarly, in the discharge port 3, the inter-tooth spaces S that are formed by the rotation of the inner rotor 5 and outer rotor 6 move so that the end portion that initially reaches the discharge port 3 constitutes the initial end portion 3*a* of the discharge port 3, and so that the end portion that is removed from the discharge port 3 as a result of the rotation of the inter-tooth spaces S constitutes the final end portion 3*b*.

Furthermore, the area between the final end portion 2*b* of the intake port 2 and the initial end portion 3*a* of the discharge port 3 constitutes a partition part 4 that partitions the intake port 2 and discharge port 3. This partition part 4 is a flat surface. Furthermore, the rotational direction of the inner rotor 5 and outer rotor 6 is assumed to be the clockwise direction. Moreover, in cases where the formation positions of the intake port 2 and discharge port 3 are disposed in opposite positions on the left and right, the rotational direction of the inner rotor 5 and outer rotor 6 is the counter-clockwise direction.

Figure 1B:
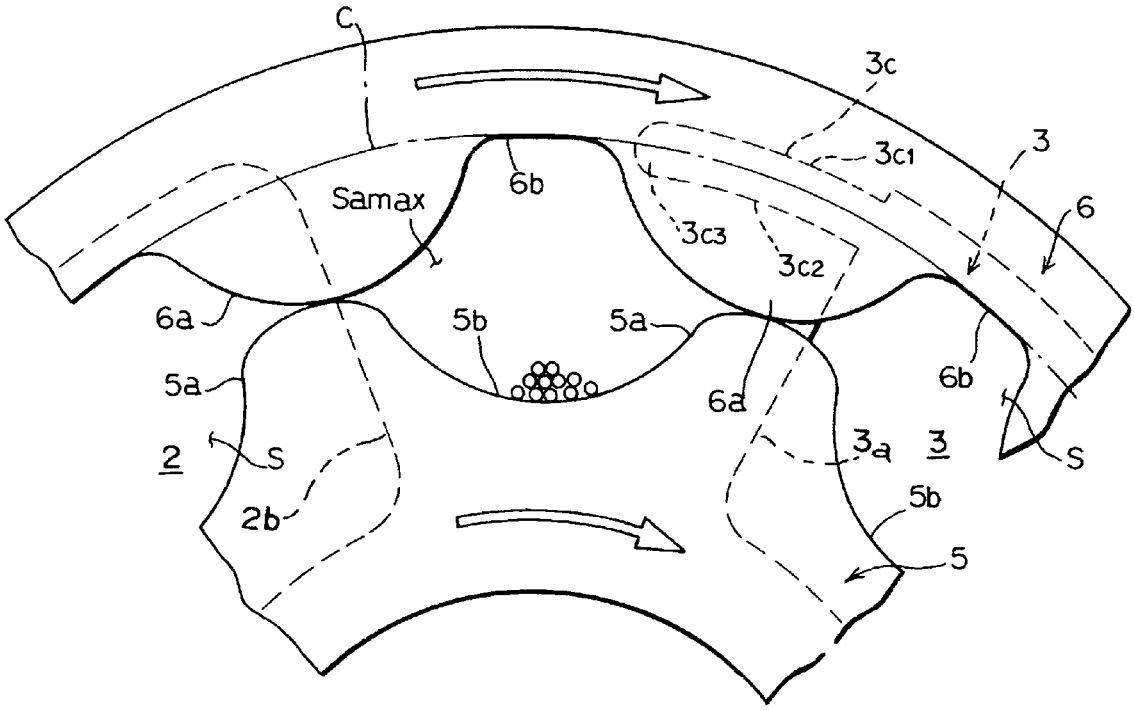
FIG. 1B is an enlarged front view of essential parts of the present invention.

Furthermore, as is shown in FIGS. 1A and 1B, the inter-tooth spaces S that are formed by the tooth shapes 5*a* and tooth bottom portions 5*b* of the inner rotor 5 and the tooth shapes 6*a* and tooth bottom portions 6*b* of the outer rotor 6 in four locations of the partition parts 4 constitute sealed spaces Sa. The sealed spaces Sa show a gradual variation in volume in the regions of the partition parts 4 as the inner rotor 5 and outer rotor 6 rotate. The maximum state of the sealed spaces Sa is called the maximum sealed space $Sa_{max}$. Specifically, when a sealed space Sa is in the state of the maximum sealed space $Sa_{max}$, this space is in a state in which the periphery is closed off so that there is no communication between the intake port 2 and discharge port 3. This maximum sealed space $S_{max}$ may also occur at the time of maximum volume.

Figure 2A:
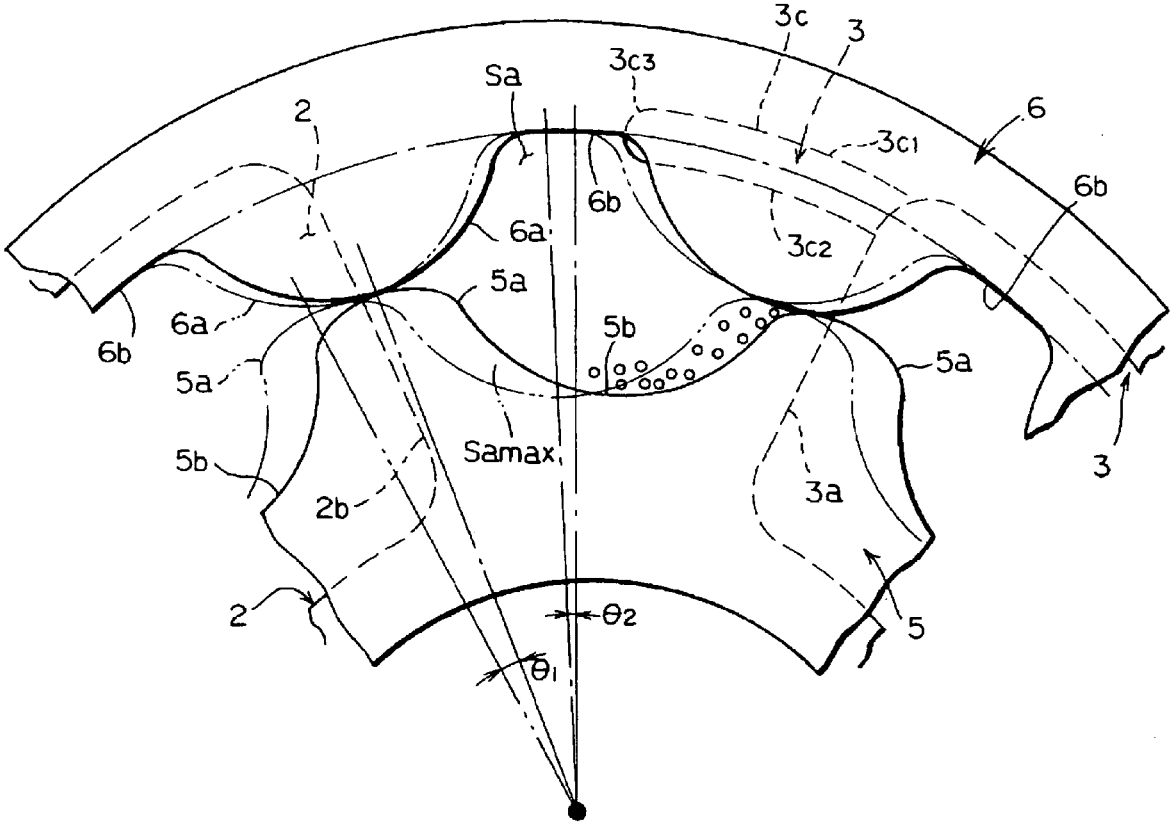
FIG. 2A is an enlarged view of essential parts showing a state in which the sealed spaces with a reduced maximum sealed space volume an the shallow grooves communicate.
Figure 2B:
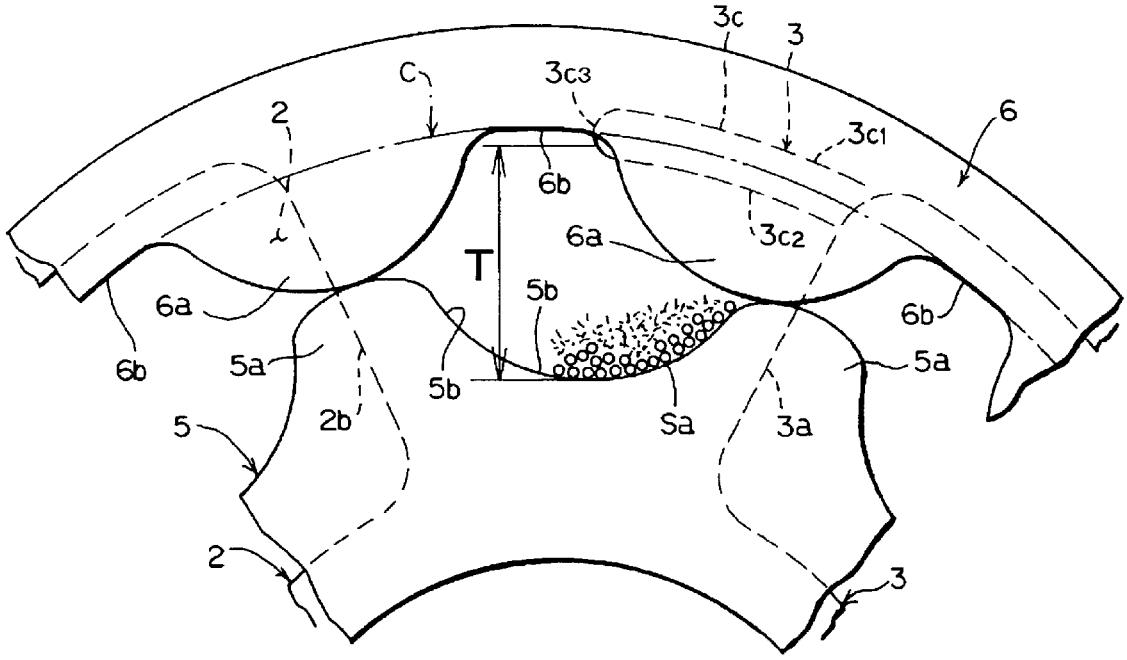
FIG. 2B is an enlarged view showing a state in which air bubbles in the oil move to the bottom portions of the teeth of the outer rotor and are gradually destroyed.

As is shown in FIGS. 1A and 1B, the shallow grooves 3*c* are formed in the initial end portion 3*a* of the discharge port 3. These shallow grooves 3*c* are formed from the partition parts 4 toward the final end portion 2*b* of the intake port 2 facing the initial end portion 3*a* of the discharge port 3. Furthermore, these shallow grooves 3*c* are devised so that in a state in which the sealed spaces Sa formed by the outer rotor 6 and inner rotor 5 move toward the discharge port 3 from the state of the maximum sealed space $Sa_{max}$ in which these sealed spaces Sa are at maximum, so that the oil inside the sealed spaces Sa is compressed while the volume of the spaces decreases, the spaces join with the shallow groove tip end portions $3c_3$ of the shallow grooves 3*c*, so that the sealed spaces Sa and shallow grooves 3*c* communicate. In this state, as is shown in FIG. 2A, the inner rotor 5 rotates by an angle of $\theta_1$ from the state of the maximum sealed space $Sa_{max}$, and the outer rotor 6 rotates by an angle of $\theta_2$ along with the rotation of the inner rotor 5, so that the sealed space Sa communicates with the shallow groove 3*c* from a sealed state; as a result of this communicating state, the space Sa ceases to be a sealed space Sa, and instead becomes a volume space Sb.

The shallow grooves 3*c* are formed in a substantially linear shape, and this linear shape is formed as a circular arc shape or rectilinear shape. Furthermore, in regard to the groove orientation of the shallow grooves 3*c*, since the grooves are formed on the circular circumference C of an imaginary track that is set by the tooth bottom portions 6*b* of the outer rotor 6, the sealed spaces Sa communicate with the shallow grooves 3*c* at points on the side of the tooth bottom portions 6*b* of the outer rotor 6. The shallow grooves 3*c* are each constructed from an outside outline part $3c_1$ and an inside outline part $3c_2$; the outside outline parts $3c_1$ are the outside edges of the shallow grooves 3*c*, and the inside outline parts $3c_2$ are the inside edges of the shallow grooves 3*c*. Furthermore, the sealed spaces Sa are set so that when these spaces move to the location of the initial end portion 3*a* of the discharge port 3, the volume decreases so that the spaces communicate with the shallow grooves 3*c* while the oil inside the spaces is compressed. It is desirable that the sealed spaces Sa be caused to communicate with the shallow grooves 3*c* in a state in which the volume of the sealed spaces Sa has decreased by 1% to 6% from the maximum (relative to the state of the maximum sealed space $Sa_{max}$).

Figure 3:
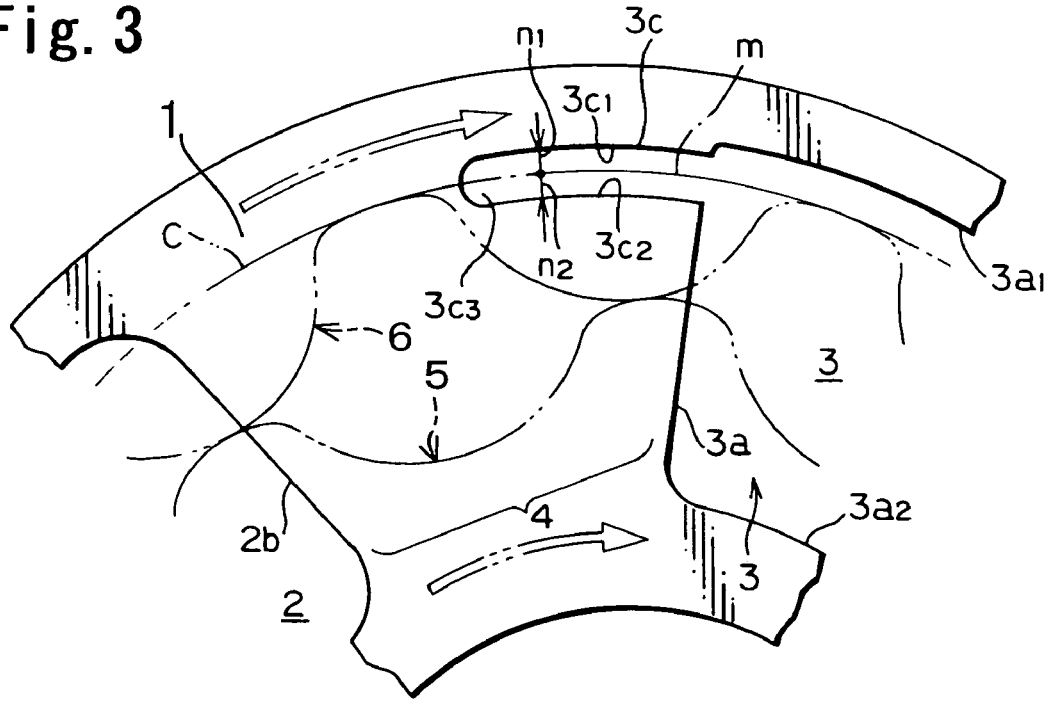
FIG. 3 is an enlarged view of the essential parts of a first type of shallow groove.

Next, the first type of shallow groove 3*c* will be described. In this first type, as is shown in FIG. 3, the center lines m of the shallow grooves 3*c* in the lateral direction of the grooves are set on the circular circumference C of the track of the positions of the tooth bottom portions 6*b* of the outer rotor 6 so as to coincide with the circular circumference C of this track, and the shallow grooves 3*c* are formed so that the groove width of these grooves is uniform (here, the term "uniform" also includes the meaning of "substantially uniform"). The shape of these shallow grooves 3*c* is a long slender circular arc shape along the circular circumference of the track. Specifically, the outside outline part $3c_1$ and inside outline part $3c_2$ are respectively formed in a circular arc shape. Here, as was described above, the description of the shallow grooves 3*c* as being "uniformly formed" means that the center lines m of the shallow grooves 3*c* and the line of the circular circumference C of the track coincide. Specifically, the distance $n_1$ from the circular circumference C of the track to the outside outline parts $3c_1$ of the shallow grooves 3*c* and the distance $n_2$ from the circular circumference C of the track to inside outline parts $3c_2$ are equal, i.e., that $n_1=n_2$ (see FIG. 3). Furthermore, this means that the outside outline parts $3c_1$ and inside outline parts $3c_2$ of the shallow grooves 3*c* have the same shape (here, the term "same shape" also includes the meaning of "substantially the same shape") centered on the circular circumference C of the track.

Figure 4:
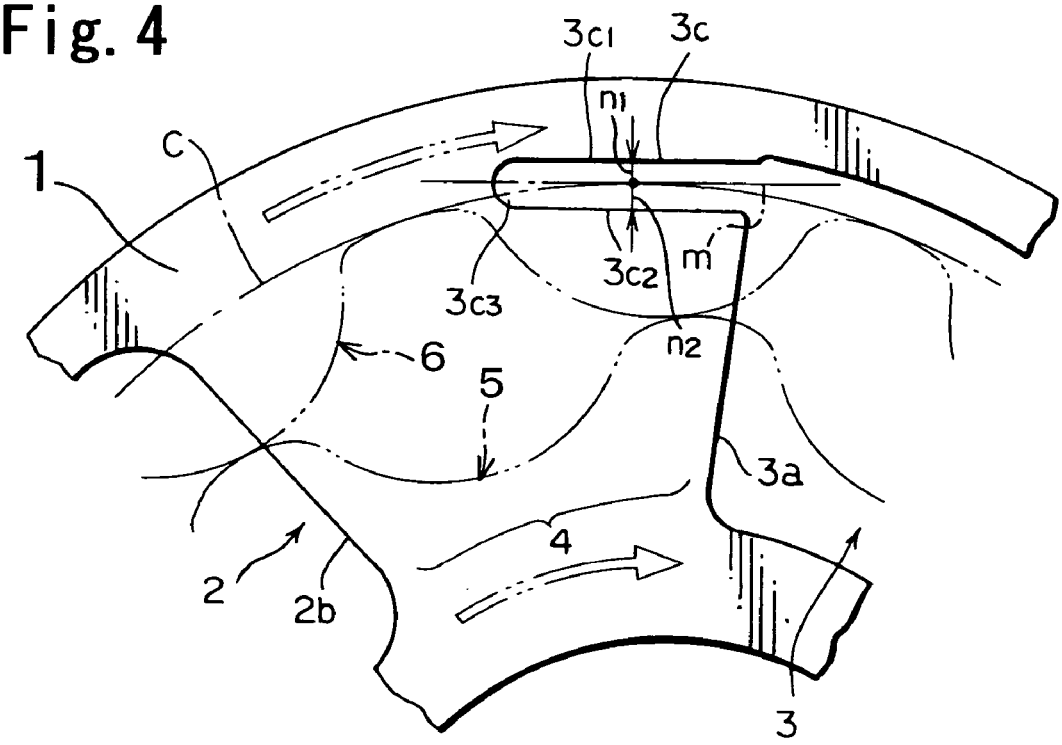
FIG. 4 is an enlarged view of the essential parts of a second type of shallow groove.

Next, in regard to the second type of shallow groove 3*c*, as is shown in FIG. 4, these shallow grooves are formed in a rectilinear shape, and are positioned so that the center lines m of the shallow grooves 3*c* are caused to approach the circular circumference C of the track, with these shallow grooves 3*c* being uniform (here, the term "uniform" includes the meaning of "substantially uniform") with respect to the circular circumference C of the track. Specifically, the center lines m are formed so that these lines extend through an appropriate range in a direction that is substantially tangential to the circular circumference C of the track. These shallow grooves 3*c* that are formed in a rectilinear shape are formed in long slender shape, rod form shape or the like. In this case, at the points of contact between the center lines m and the circular circumference C of the track, the distance $n_1$ of the outside outline parts $3c_1$ of the shallow grooves 3*c* from the circular circumference C of the track and the distance $n_2$ of the inside outline parts $3c_2$ from the circular circumference C of the track are equal (see FIG. 4).

Figure 5:
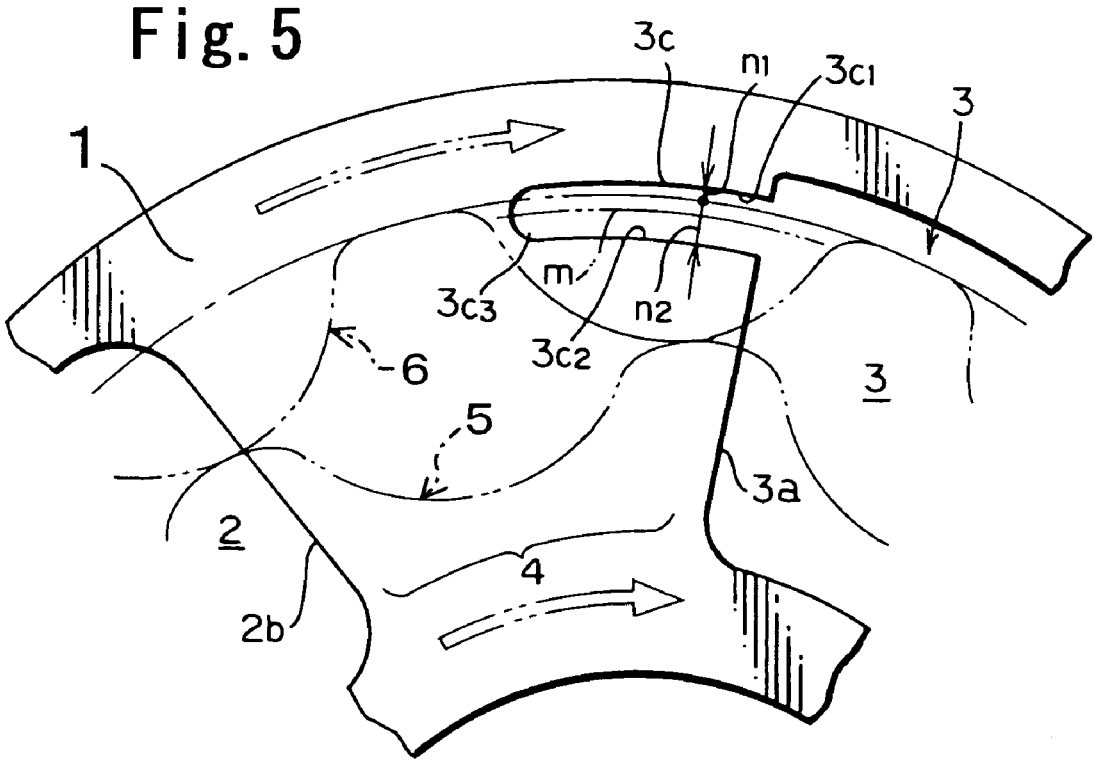
FIG. 5 is an enlarged view of the essential parts of a third type of shallow groove.

Next, in regard to the third type of shallow groove 3*c*, as is shown in FIG. 5, these shallow grooves are formed so that the groove width of the shallow grooves 3*c* is non-uniform with respect to the circular circumference C of the track of the positions of the tooth bottom parts 6*b* of the outer rotor 6. Here, the distance $n_1$ from the circular circumference C of the track to the outside outline parts $3c_1$ of the shallow groove 3*c* and the distance $n_2$ from the circular circumference C of the track to the inside outline parts $3c_2$ are different, i.e., $n_1 \neq n_2$. Specifically, in cases where the positions of the center lines m of the grooves in the lateral direction do not coincide with the circular circumference C of the track, and the outside outline part $3c_1$ and inside outline parts $3c_2$ of the shallow grooves 3*c* have symmetrical shapes with respect to the center lines m, these shallow grooves 3*c* are positioned in an offset state. Furthermore, in cases where the shapes of the outside outline parts $3c_1$ and inside outline parts $3c_2$ are asymmetrical with respect to the center lines m of the shallow grooves 3*c*, the groove widths are non-uniform with respect to the circular circumference C of the track as a result of appropriate positioning on the circular circumference C of the track. Specifically, since the center lines m of the shallow grooves 3*c* are not positioned on the circular circumference C of the track, the groove widths of the shallow grooves 3*c* are non-uniform with respect to the circular circumference C of the track.

Figure 6:
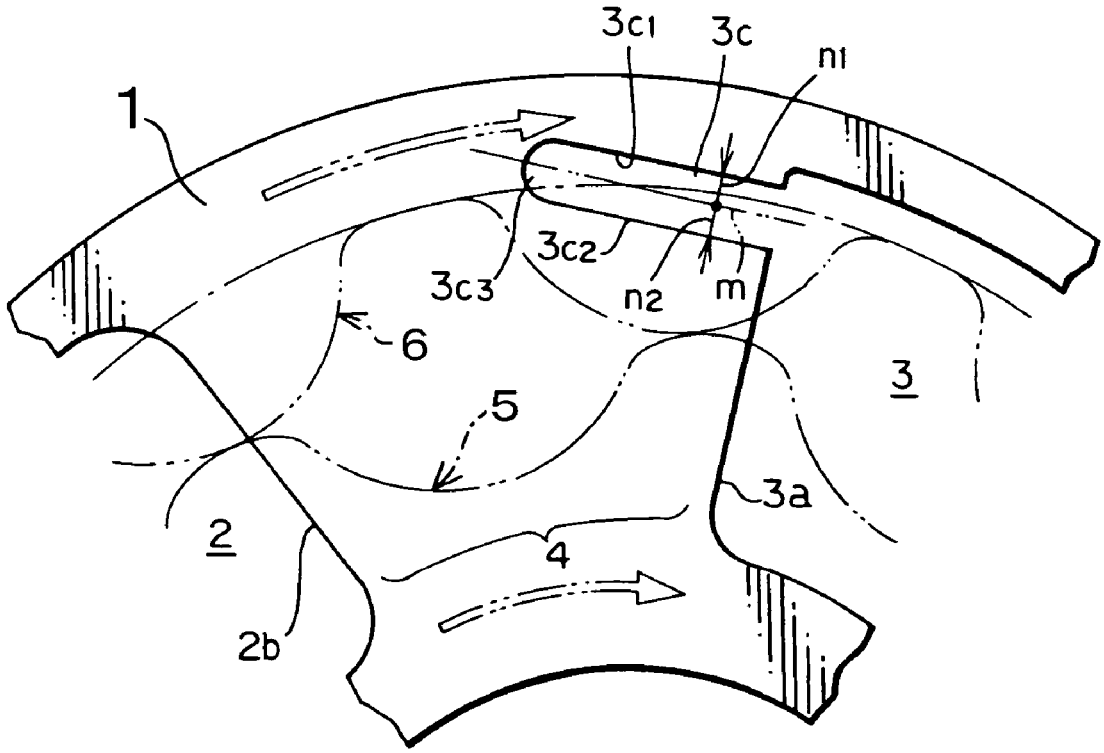
FIG. 6 is an enlarged view of the essential parts of a fourth type of shallow groove.

In regard to the fourth type of shallow groove 3*c*, as is shown in FIG. 6, these shallow grooves have a rectilinear shape. Furthermore, these shallow grooves are formed so that the groove widths of the shallow grooves 3*c* are non-uniform with respect to the circular circumference C of the track of the positions of the tooth bottom portions 6*b* of the outer rotor 6, and so that the positions of the center lines m do not coincide with the circular circumference C of the track. Specifically, the relationship of the distance $n_1$ between the circular circumference C of the track and the outside outline parts $3c_1$ and the distance $n_2$ between the circular circumference C of the track and the inside outline parts $3c_2$ in the positions of the shallow grooves 3*c* near the discharge port 3 is such that $n_1 \neq n_2$. In this case, the groove width of the shallow grooves 3*c* is symmetrical. The positioning of the center of the groove width of the shallow grooves 3*c* on the inside or outside with respect to this circular circumference C of the track may be appropriately selected.

Figure 7:
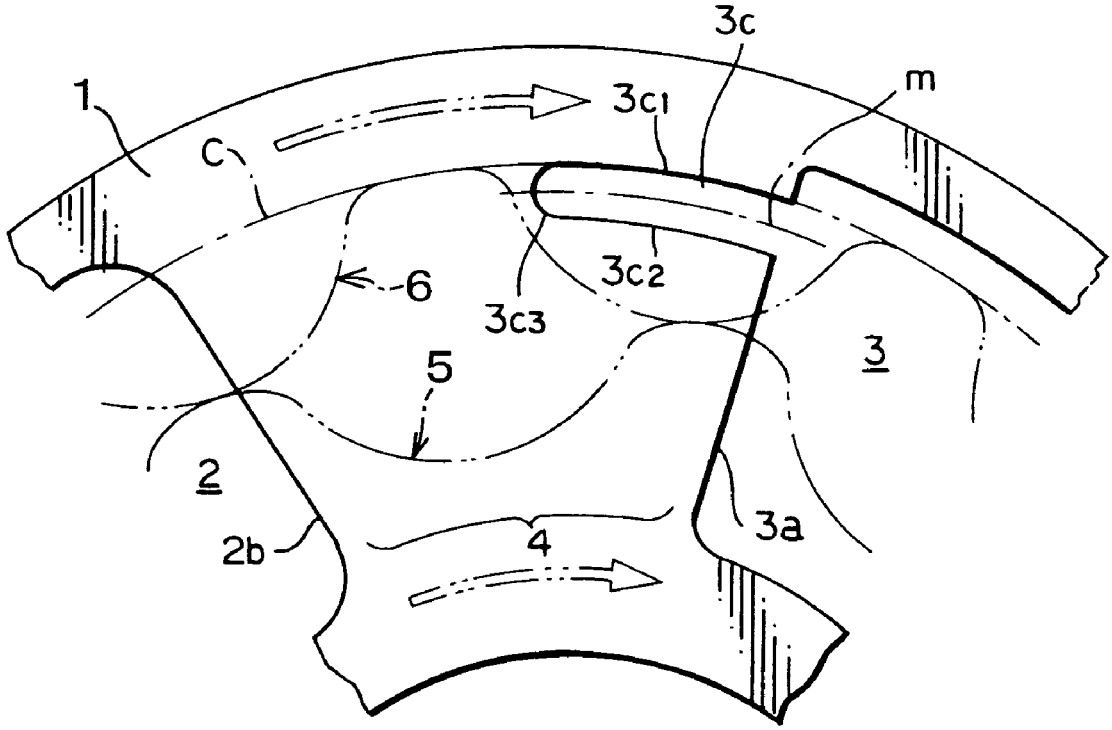
FIG. 7 is an enlarged view of the essential parts of a fifth type of shallow groove.
Figure 8:
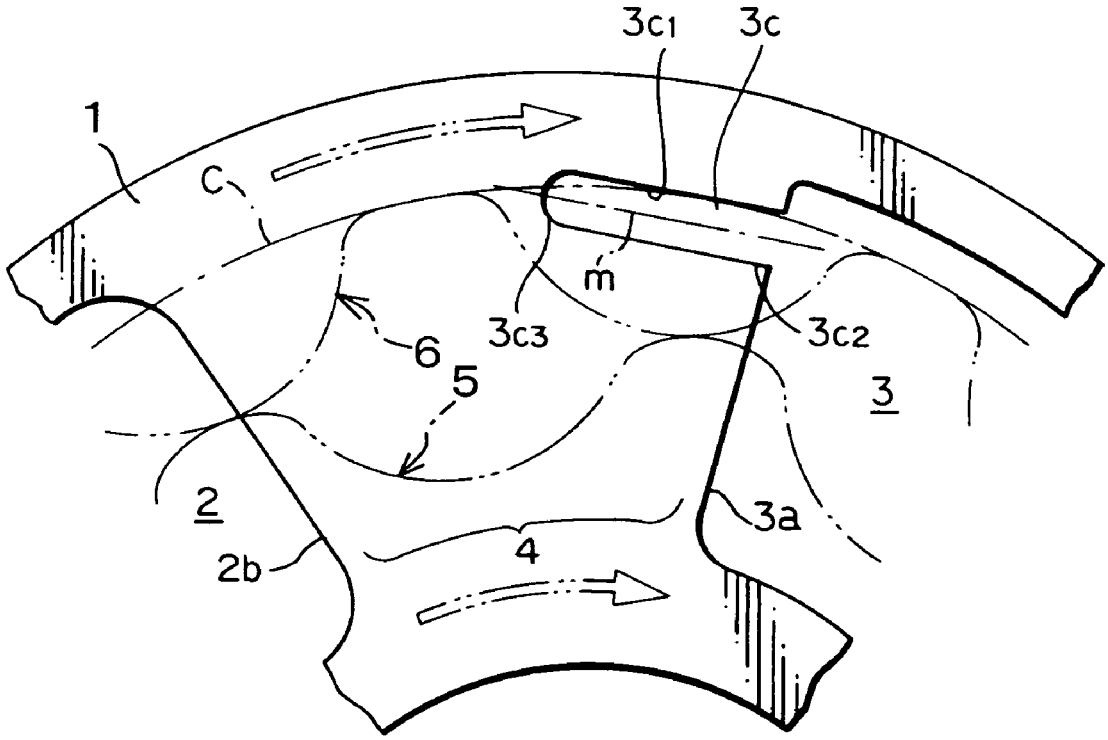
FIG. 8 is an enlarged view of the essential parts of a sixth type of shallow groove.

Furthermore, in regard to the fifth type, as is shown in FIG. 7, these are shallow grooves 3*c* in which a portion of the shallow groove is always present on the inner circumferential side with respect to the circular circumference C of the track. There is also a type in which the distance between the center lines m of the shallow grooves 3*c* and the circular circumference C of the track is the maximum distance, and the positions of the circular circumference C of the track and the outside outline parts $3c_1$ of the shallow grooves 3*c* coincide. Furthermore, there is also a type in which the inside outline parts $3c_2$ of the shallow grooves 3*c* and the circular circumference C of the track coincide if the sealed spaces Sa and shallow grooves 3*c* communicate, and the groove width of the shallow grooves 3*c* as a whole is positioned on the outside of the circular circumference C of the track. FIG. 8 shows this sixth type of shallow groove 3*c*, which is a type formed by making the fifth type of shallow groove 3*c* rectilinear.

Figure 9:
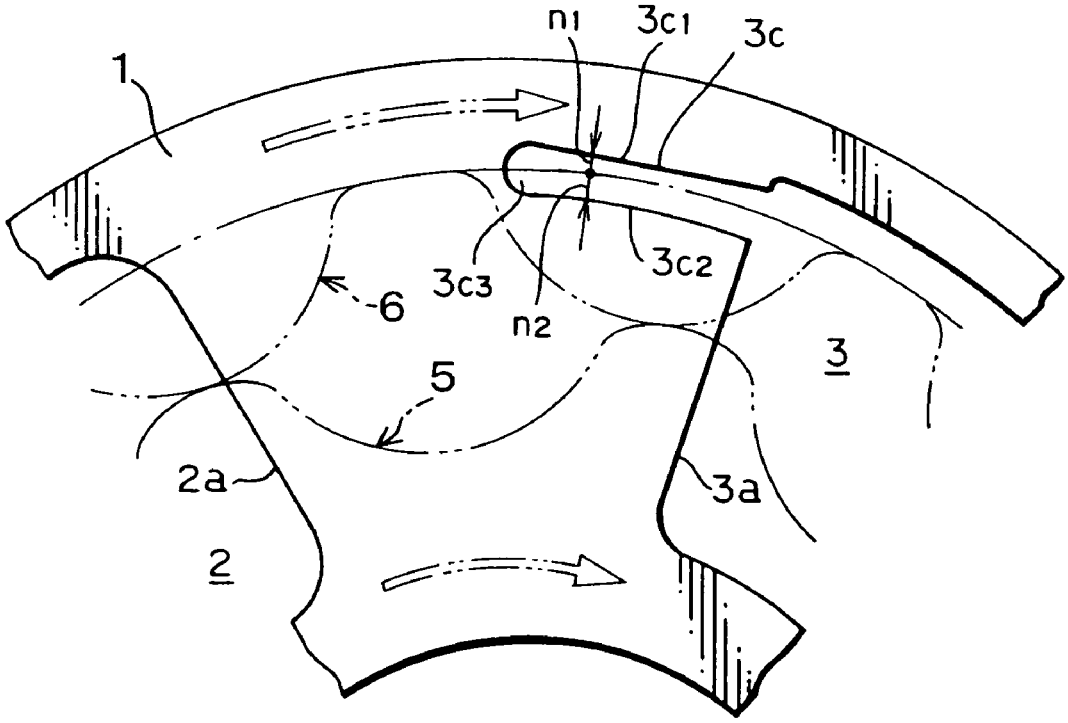
FIG. 9 is an enlarged view of the essential parts of a seventh type of shallow groove.
Figure 10:
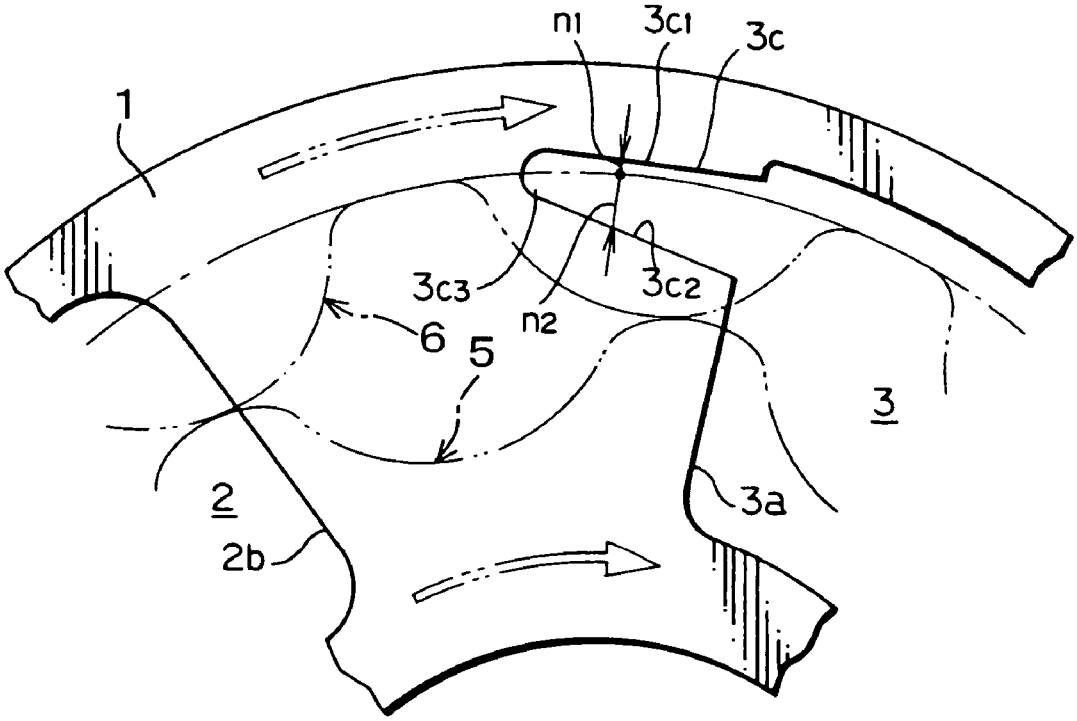
FIG. 10 is an enlarged view of the essential parts of an eighth type of shallow groove.

Next, in regard to the seventh type of shallow groove 3*c*, as is shown in FIG. 9, these are shallow grooves 3*c* in which the shape of the shallow grooves 3*c* is asymmetrical in the lateral direction of the grooves, and is non-uniform. Here, the shapes of the outside outline parts $3c_1$ and inside outline parts $3c_2$ are different; the outside outline parts $3c_1$ have a rectilinear shape, while the inside outline parts $3c_2$ are formed in the shape of a circular arc. In this seventh type as well, the distance $n_1$ from the circular circumference C of the track to the outside outline parts $3c_1$ of the shallow grooves 3*c* and the distance $n_2$ from the circular circumference C of the track to the inside outline parts $3c_2$ are different, so that $n_1 \neq n_2$. Furthermore, FIG. 10 shows an eighth type of shallow groove 3*c*; these shallow grooves are formed in a substantially triangular shape by the outside outline parts $3c_1$ and inside outline parts $3c_2$. Here, since the center of the groove width of the shallow grooves 3*c* is unclear, the groove width becomes non-uniform with respect to the circular circumference C of the track if the shallow grooves 3*c* are positioned on the circular circumference C of the track. In this case, even if the center of the groove width of the shallow grooves 3*c* is unclear, positioning at the maximum inside position with respect to the circular circumference C of the track means that the outline parts of the shallow grooves 3*c* are positioned in the same manner as described above. In this eighth type, the distance $n_1$ from the circular circumference C of the track to the outside outline parts $3c_1$ in appropriate positions of the shallow grooves 3*c* in the lateral direction and the distance $n_2$ from the circular circumference C of the track to the inside outline parts $3c_2$ are different, so that $n_1 \neq n_2$. Furthermore, it is desirable that the shapes of the outline parts of the shallow grooves 3*c* be shapes that run along the circular circumference C of the track. In this regard, the shapes of the groove widths of the shallow grooves 3*c* may be either symmetrical or asymmetrical.

Figure 11:
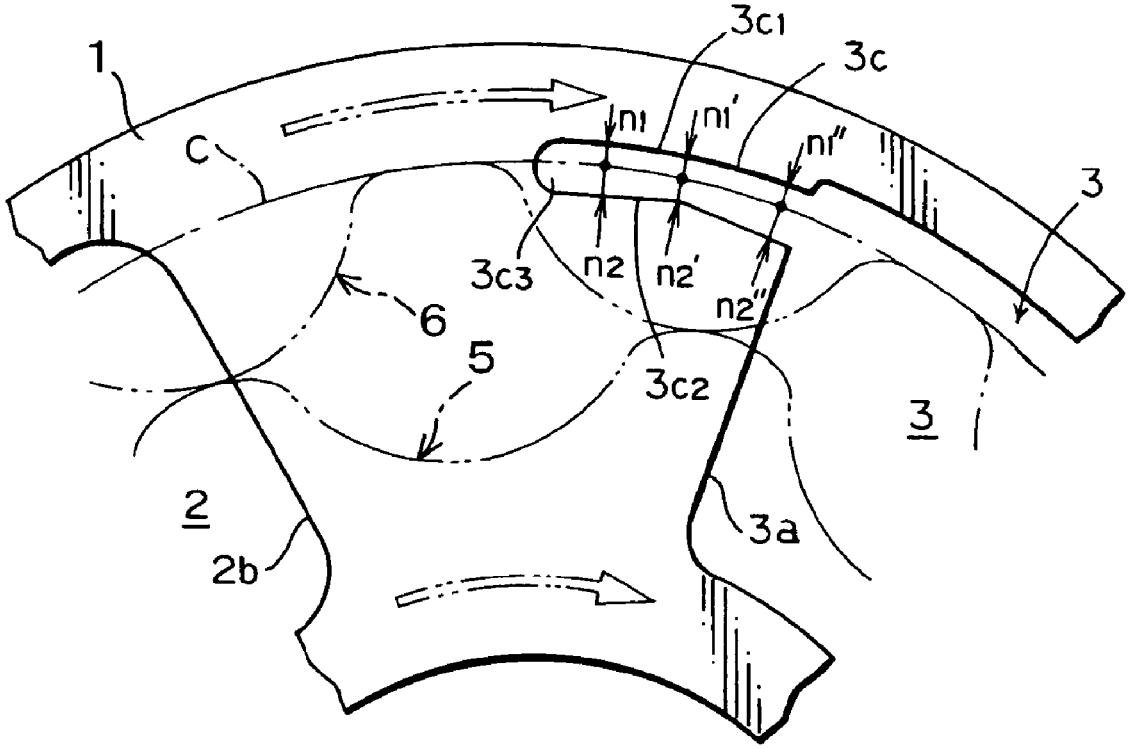
FIG. 11 is an enlarged view of the essential parts of a ninth type of shallow groove.

Furthermore, in regard to the ninth type of shallow groove 3*c*, as is shown in FIG. 11, these are shallow grooves 3*c* in which the outside outline parts $3c_1$ are formed in a circular arc shape, and the inside outline parts $3c_2$ are formed in a bent rectilinear shape. The shallow grooves 3*c* of this ninth type have an asymmetrical shape centered on the circular circumference C of the track. Furthermore, the distance $n_1$ between the circular circumference C of the track and the outside outline parts $3c_1$, the distance $n_1'$ and distance $n_2'$ between the circular circumference C of the track and the inside outline parts $3c_2$, and the distance $n_1''$ and distance $n_2''$ between the circular circumference C of the track and the inside outline parts $3c_2$ at three appropriate points along the lateral direction of the shallow grooves 3*c* are as follows: specifically, $n_1<n_2$, $n_1'>n_2'$, and $n_1''<n_2''$. Furthermore, $n_1''$ may also equal $n_2''$.

Next, the operation will be described. First, the fact that large quantities of cavitation bubbles are generated in the positions of the tooth bottom portions 5*b* of the inner rotor 5 in the intake stroke of the pump has been verified by cavitation erosion. Since the complete elimination of such cavitation bubbles is impossible, the aim here is to reduce the effects caused by cavitation bubble destruction (cavitation erosion, vibration, noise and the like), i.e., the focus is on the destructive force of cavitation bubbles.

In the intake stroke of the oil pump, cavitation bubbles contained in the oil are present in the maximum sealed space $Sa_{max}$ between the outer rotor 6 and inner rotor 5. However, as a result of the centrifugal force arising from the rotation of the rotors, the oil inside the sealed spaces Sa moves to the outside (toward the outer rotor 6), while the cavitation bubbles are present on the inside (in the tooth bottom portions 5*b* of the inner rotor 5). The apparent reason for this is that the oil, which has a larger mass than the cavitation bubbles, is caused to move toward the outer rotor 6 inside the sealed spaces Sa by the centrifugal force, while the cavitation bubbles are present in the tooth bottom portions 5*b* of the inner rotor 5 on the opposite side.

Figure 14A:
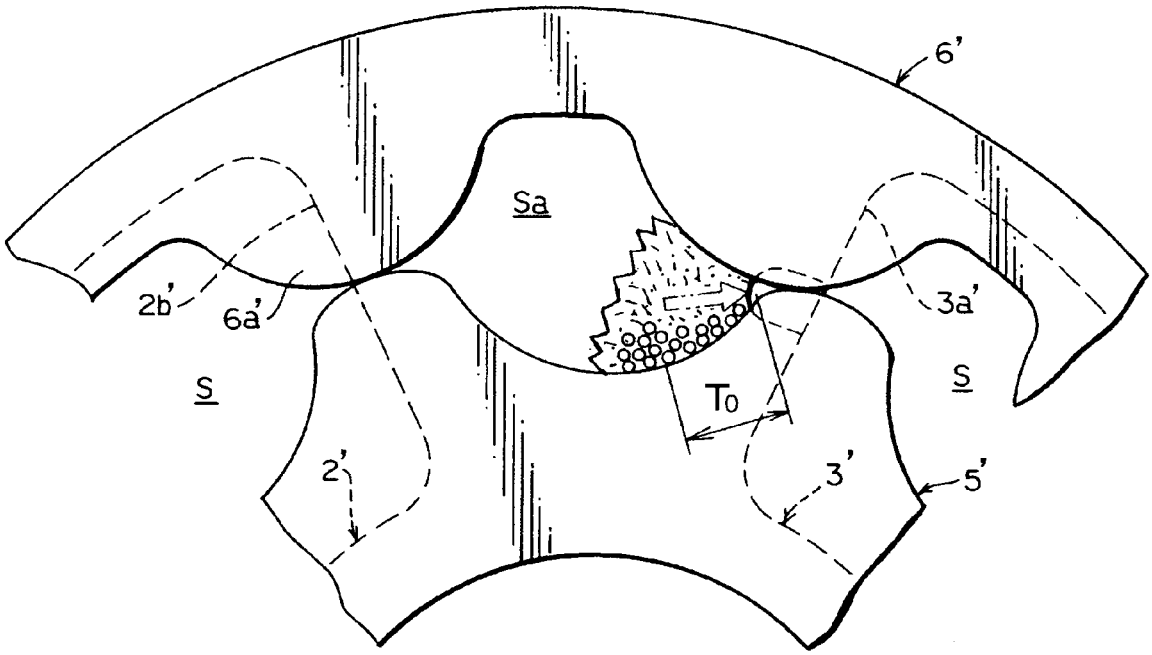
FIG. 14A is a front view of an example of the prior art.
Figure 14B:
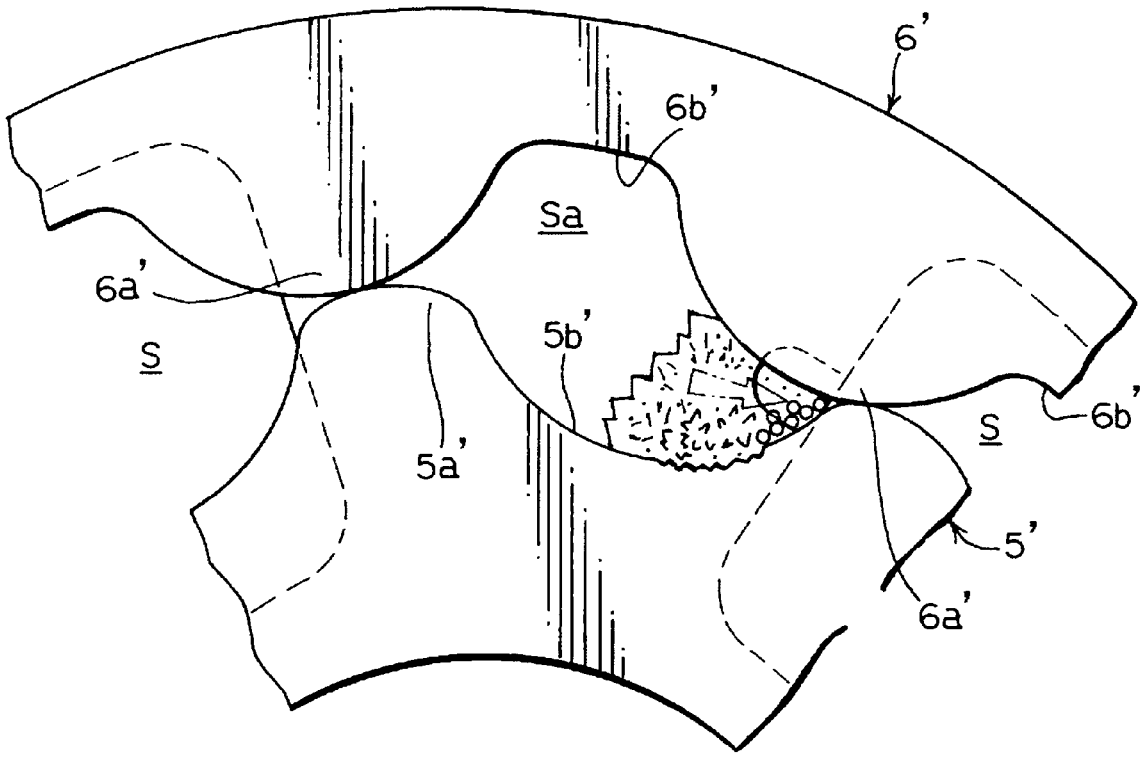
FIG. 14B is a front view showing the condition of the bottom portions of the teeth of the inner rotor eroded by cavitation in the prior art.

In a conventional oil pump, the communication passages between the sealed spaces Sa in the state of the maximum sealed space $Sa_{max}$ and the discharge port 3' are formed from the vicinity of the engagement pitch line between the outer rotor 6' and the inner rotor 5'; accordingly, as is shown in FIG. 14A, the distance $T_0$ from the tooth bottom positions of the inner rotor 5' where large quantities of cavitation bubbles are present is short. Accordingly, the cavitation bubbles inside the sealed spaces Sa are quickly destroyed, so that this impact causes cavitation erosion of the tooth bottom portions 5*b'* of the inner rotor 5' as shown in FIG. 14B. In the present invention, on the other hand, the system is devised so that there is communication with the discharge port 3 via shallow grooves 3*c* on the circular circumference C of the track of the positions of the tooth bottom portions 6*b* of the outer rotor 6, which is located at a long distance T from the positions of the tooth bottom portions 5*b* of the inner rotor 5 where large quantities of cavitation bubbles are present. As a result, the cavitation bubbles are not immediately destroyed, but are rather gradually destroyed, so that the impact is reduced.

Specifically, in the present invention, the discharge initiation position is set by causing shallow grooves 3*c* located on the circular circumference C of the track of the positions of the tooth bottom portions 6*b* of the outer rotor 6, which is separated by a long distance T from the positions of the tooth bottom portions 5*b* of the inner rotor 5 where large quantities of cavitation bubbles are present, to communicate with the sealed spaces Sa in the direction of the circular circumference C of the track, so that the destructive force of the cavitation bubbles is reduced.

Furthermore, since the sealed spaces Sa are caused to communicate with the shallow grooves 3*c* in a state in which the volume has been reduced by 1% to 6% from the state of the maximum sealed space $Sa_{max}$, discharge can be accomplished via the shallow grooves 3*c* with the interiors of the sealed spaces Sa set in a positive pressure state. As a result, there is no abrupt creation of a state of communication between the sealed spaces Sa and the discharge port 3 in a positive pressure state, so that pressure variations can be suppressed, and the destructive force of the cavitation bubbles can be reduced even further. Moreover, since the impact of the communication with the discharge port 3 can be reduced, vibration and noise can be reduced even further.

The rate of communication between the sealed spaces Sa and shallow grooves 3*c* can be appropriately reduced by making the shape of the shallow grooves 3*c* uniform or non-uniform. Furthermore, the uniformity or non-uniformity of the shallow grooves 3*c* allows the appropriate setting of the proportional size of the openings in the communication between the sealed spaces Sa and the shallow grooves 3*c*, so that (for example) a favorable state of communication with the discharge port 3 (constriction adjustment or gradual communication) can easily be set.

Figure 13A:
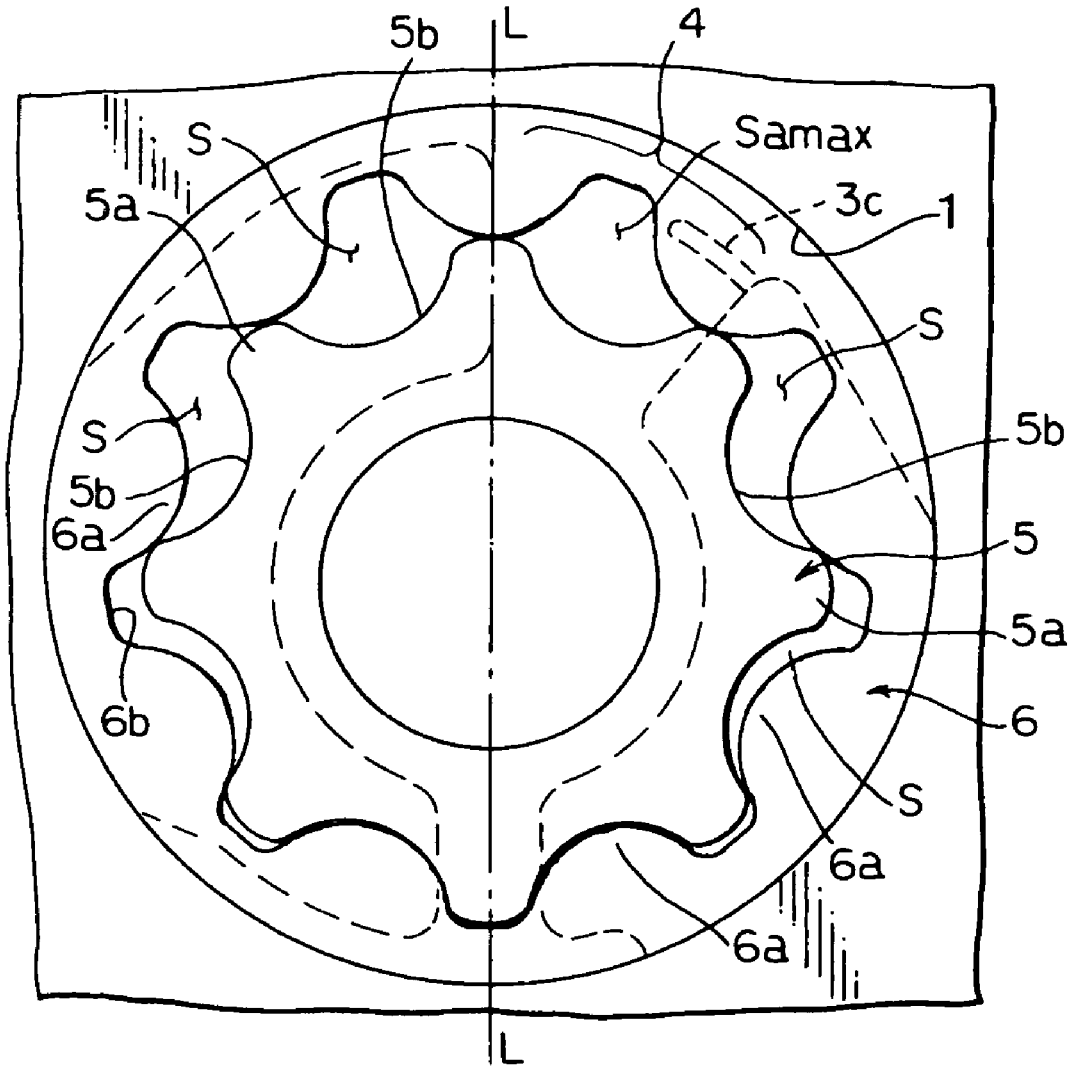
FIG. 13A is a front view of a pump in which the final end portion of the intake port is caused to approach a line of left-right symmetry, an the initial end portion of the intake port is separated.
Figure 13B:
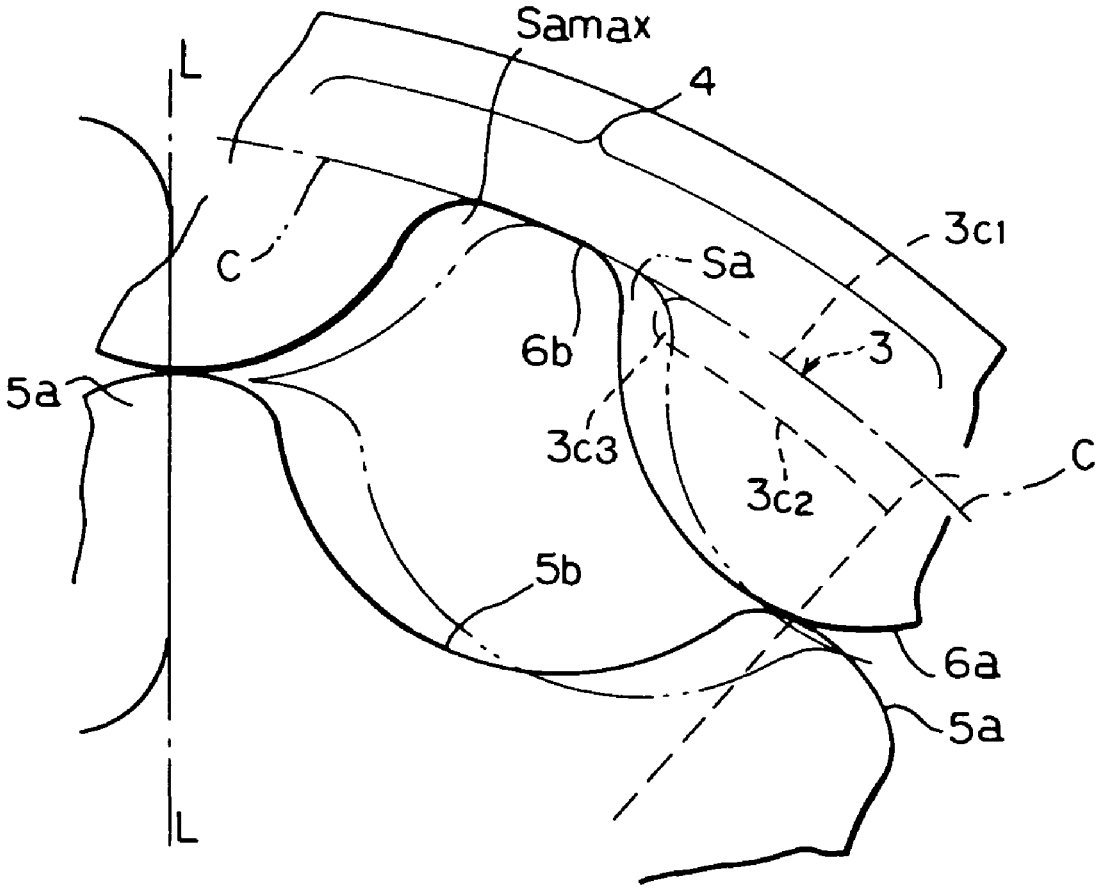
FIG. 13B is an enlarged view of the sealed space.

Furthermore, in regard to the formation positions of the final end portion 2*b* of the intake port 2 and the initial end portion 3*a* of the discharge port inside the rotor chamber 1, as is shown in FIG. 13A, the line L of left-right symmetry of the rotor chamber 1 may be taken as the center, and the final end portion 2*b* of the intake port 2 may be formed in the vicinity of this line L of left-right symmetry, while the initial end portion 3*a* of the discharge port 3 is formed at a point separated from this line L of left-right symmetry. The partition part 4 is formed toward the side of the discharge port 3 from the line L of left-right symmetry. In FIG. 13A, this means that this part is formed on the right side with respect to the line L of left-right symmetry. In this case as well, the location where the sealed spaces Sa and the initial end portion of the discharge port communicate is similarly the position of the tooth bottom portions 6*b* of the outer rotor 6.

Figure 12:
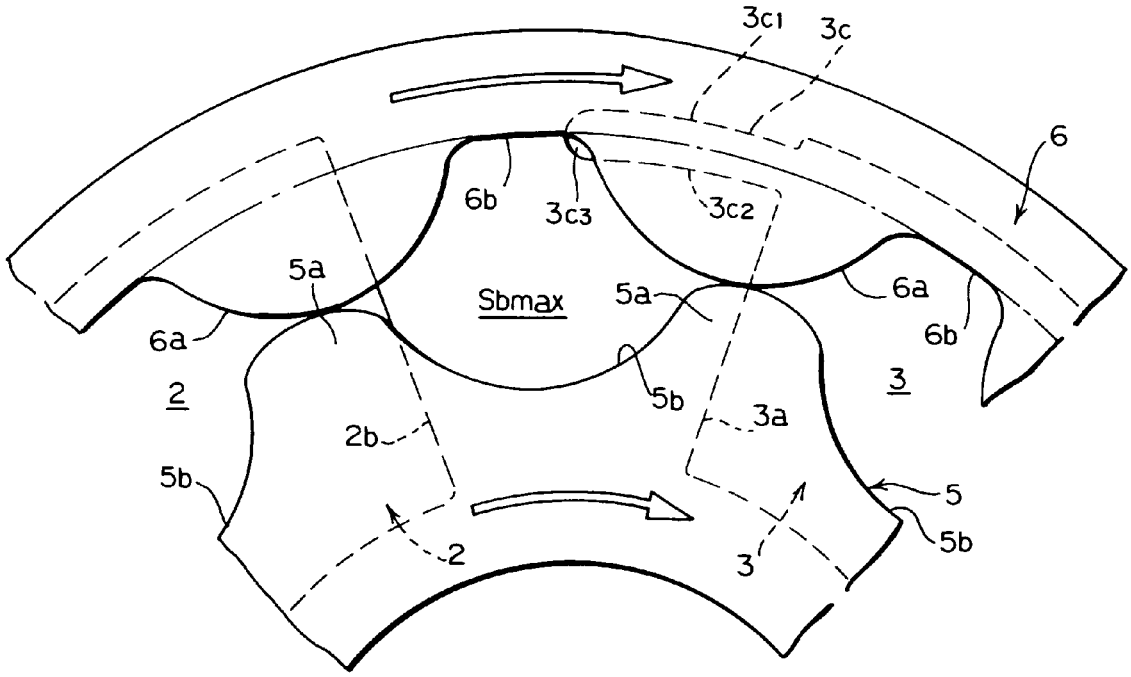
FIG. 12 is an enlarged front view of essential parts showing a second embodiment of the present invention.

Furthermore, in a second embodiment of the present invention, as is shown in FIG. 12, a volume space Sb which is present in the position of the partition part 4 is provided, and the system is set so that when the volume of this space is at a maximum, i.e., in the case of a maximum volume space $Sb_{max}$, the intake port 2 is simultaneously caused to communicate with the shallow grooves 3*c*. In this case, when the volume space Sb is at a maximum, the space communicates with the shallow groove 3*c* of the discharge port 3, and also has a slight communication with the intake port 2. Accordingly, the intake and filling amount of oil from the intake port 2 can be increased during especially high rotation of the pump; consequently, the pump discharge amount can be increased. As a result, furthermore, the quantity of cavitation bubbles can be reduced. Since the destructive force of the reduced cavitation bubbles can be reduced, cavitation erosion can be reduced even further.

In regard to the effect, the effects of cavitation can be greatly reduced by means of an extremely simple structure in which shallow grooves 3*c* are provided which initiate discharge from the positions of the tooth bottom portions 6*b* of the outer rotor 6. Furthermore, as a result of the use of this simple structure, the present invention can easily be applied to various trochoid type oil pumps. Furthermore, in cases where the housing is formed by die casting using a metal mold, the shallow grooves of the present invention can easily be formed during the molding of the housing.

Furthermore, in the state of the maximum volume space $Sb_{max}$, the system can be set so that this space is cut off from the intake port, and is simultaneously caused to communicate with the shallow grooves 3*c*. In this way as well, the quantity of cavitation bubbles can be reduced, and the destructive force of the cavitation bubbles can be reduced.

What is claimed is:

1. A trochoid type oil pump comprising:

a rotor chamber comprising an intake port and a discharge port;

outer and inner rotors; and shallow grooves formed on a side of an initial end portion of said discharge port on a circular circumference of a track of positions of bottom portions of teeth created by the rotation of said outer rotor, wherein, in a state in which sealed spaces formed by said outer rotor, said inner rotor and a partition part between a final end portion of said intake port and the initial end portion of said discharge port are decreased from a maximum value, said sealed spaces communicate with one of said shallow grooves in which the position of discharge initiation is separated from the position of the bottom portions of the teeth of the inner rotor and whose groove width is positioned on the circular circumference of the track of the positions of the bottom portions of the teeth of the outer rotor are established, and said sealed spaces are caused to continuously communicate with said shallow grooves in the direction of the circular circumference of the track.

2. The trochoid type oil pump according to claim 1, wherein, in a maximum state of said sealed spaces, the sealed spaces are caused to communicate with said shallow grooves in a state in which a volume of said sealed spaces is decreased by 1% to 6%.

3. The trochoid type oil pump according to claim 1, wherein said shallow grooves are formed in one of a substantially circular arc shape and a substantially rectilinear shape along a longitudinal direction, and the shapes of outside outline parts and inside outline parts of said shallow grooves are uniformly formed on the circular circumference of the track of the positions of the bottom portions of the teeth of said outer rotor.

4. The trochoid type oil pump according to claim 1, wherein said shallow grooves are formed in one of a substantially circular arc shape and a substantially rectilinear shape along a longitudinal direction, and the shapes of outside outline parts and inside outline parts of said shallow grooves are non-uniformly formed on the circular circumference of the track of the positions of the bottom portions of the teeth of said outer rotor.

5. A trochoid type oil pump comprising:

a rotor chamber comprising an intake port and a discharge port;

outer and inner rotors; and shallow grooves formed on a side of an initial end portion of said discharge port on a circular circumference of a track of positions of bottom portions of teeth created by the rotation of said outer rotor, wherein, in a state in which a volume space formed by said outer rotor, said inner rotor and a partition plate between a final end portion of said intake port and the initial end portion of said discharge port is at a maximum, said volume space communicates with one of said shallow grooves in which the position of discharge initiation is separated from the position of the bottom portions of the teeth of the inner rotor and whose groove width is positioned on the circular circumference of the track of the positions of the bottom portions of the teeth of the outer rotor, and said intake port and said shallow grooves.

6. The trochoid type oil pump according to claim 2, wherein said shallow grooves are formed in one of a substantially circular arc shape and a substantially rectilinear shape along a longitudinal direction, and shapes of outside outline parts and inside outline parts of said shallow grooves are uniformly formed on the circular circumference of the track of the positions of the bottom portions of the teeth of said outer rotor.

7. The trochoid type oil pump according to claim 2, wherein said shallow grooves are formed in one of a substantially circular arc shape and a substantially rectilinear shape along a longitudinal direction, and shapes of outside outline parts and inside outline parts of said shallow grooves are non-uniformly formed on the circular circumference of the track of the positions of the bottom portions of the teeth of said outer rotor.

8. The trochoid type oil pump according to claim 2, wherein said shallow grooves are formed in one of a substantially circular arc shape and a substantially rectilinear shape along a longitudinal direction, and at least one portion of shapes of one of an outside outline parts and an inside outline of parts of said shallow grooves are aligned on the circular circumference of the track of the positions of the bottom portions of the teeth of said outer rotor.

9. The trochoid type oil pump according to claim 2, wherein said shallow grooves are formed of a substantially circular arc shape and a substantially rectilinear shape along a longitudinal direction, and shapes of outside outline parts and inside outline parts of said shallow grooves are non-uniformly formed on the circular circumference of the track of the positions of the bottom portions of the teeth of said outer rotor.

10. The trochoid type oil pump according to claim 2, wherein said shallow grooves are formed of a substantially triangular shape along a longitudinal direction, and shapes of outside outline parts and inside outline parts of said shallow grooves are non-uniformly formed on the circular circumference of the track of the positions of the bottom portions of the teeth of said outer rotor.

11. The trochoid type oil pump according to claim 2, wherein said shallow grooves are formed of a substantially circular arc shape and a bent rectangular shape along a longitudinal direction, and said circular arc shape of outside outline parts and said bent rectangular shape of inside outline parts of said shallow grooves are non-uniformly formed on the circular circumference of the track of the positions of the bottom portions of the teeth of said outer rotor.

12. The trochoid type oil pump according to claim 2, wherein when said sealed spaces are at a maximum, the sealed spaces communicate with the shallow grooves of the discharge port.

13. The trochoid type oil pump according to claim 2, wherein when said sealed spaces are at a maximum, the sealed spaces communicate with the shallow grooves of the intake port.

14. The trochoid type oil pump according to claim 1, wherein said final end portion of said discharge port and said initial end portion of said intake port are symmetrically disposed about a center line of said oil pump, and said final end portion of said intake port and said initial end portion of said discharge port are symmetrically disposed about said center line of said oil pump.

15. The trochoid type oil pump according to claim 1, wherein said final end portion of said discharge port and said initial end portion of said intake port are symmetrically disposed about a center line of said oil pump, and said final end portion of said intake port and said initial end portion of said discharge port are non-symmetrically disposed about said center line of said oil pump.

16. The trochoid type oil pump according to claim 2, wherein said shallow grooves are formed in a substantially circular arc shape along a longitudinal direction, and shapes of outside outline parts and inside outline parts of said shallow grooves are formed on the circular circumference of the track of the positions of the bottom portions of the teeth of said outer rotor.

17. The trochoid type oil pump according to claim 2, wherein said shallow grooves are formed in a substantially rectilinear shape along a longitudinal direction, and shapes of outside outline parts and inside outline parts of said shallow grooves are formed on the circular circumference of the track of the positions of the bottom portions of the teeth of said outer rotor.

18. The trochoid type oil pump according to claim 2, wherein said shallow grooves are formed in one of a substantially circular arc shape and a substantially rectilinear shape along a longitudinal direction, and shapes of outside outline parts and inside outline parts of said shallow grooves are aligned on the circular circumference of the track of the positions of the bottom portions of the teeth of said outer rotor.

19. The trochoid type oil pump according to claim 2, wherein said shallow grooves are formed in one of a substantially circular arc shape and a substantially rectilinear shape along a longitudinal direction, and shapes of outside outline parts and inside outline parts of said shallow grooves are off-set a distance from the circular circumference of the track of the positions of the bottom portions of the teeth of said outer rotor.

20. The trochoid type oil pump according to claim 2, wherein said shallow grooves are formed in one of a substantially circular arc shape and a substantially rectilinear shape along a longitudinal direction, and at least one portion of shapes of outside outline parts of said shallow grooves are aligned on top of the circular circumference of the track of the positions of the bottom portions of the teeth of said outer rotor.

* * * * *